United States Patent [19]

Tubota et al.

[11] Patent Number: 5,071,083

[45] Date of Patent: Dec. 10, 1991

[54] TOUCH ROLLER FOR PLASTIC POLYMER FILM MANUFACTURING APPARATUS

[75] Inventors: Yoshitake Tubota; Haruyasu Shigeta, both of Takefu, Japan

[73] Assignee: Shin-Etsu Film Co., Ltd., Tokyo, Japan

[21] Appl. No.: 456,700

[22] Filed: Dec. 26, 1989

[30] Foreign Application Priority Data

Dec. 26, 1988 [JP] Japan ..... 63-168528[U]

[51] Int. Cl.[5] ..... B65H 18/10

[52] U.S. Cl. ..... 242/67.1 R; 226/193; 29/121.8

[58] Field of Search ..... 242/67.1 R, 67.2, 65, 242/66, 75.1, 76; 226/193; 29/121.2, 121.4, 121.8

[56] References Cited

U.S. PATENT DOCUMENTS

| | | | |
|---|---|---|---|
| 3,089,415 | 5/1963 | Grembecki et al. | 29/121.4 X |
| 3,240,442 | 3/1966 | Kilmartin | 242/66 |
| 4,025,009 | 5/1977 | Fineo | 242/66 |
| 4,429,823 | 2/1984 | Umehara | 242/76 X |

*Primary Examiner*—John M. Jillions

*Attorney, Agent, or Firm*—Lowe, Price, LeBlanc and Becker

[57] ABSTRACT

A metallic touch roller for use in an apparatus for manufacturing film rolls. The outer surface of the touch roller has a matte-finish with a plurality of symmetrically formed spiral grooves extending over the length of the roller. A mean surface roughness of the matte-finished surface may be from 0.5 to 2.0 μm and, preferably, from 1.0 to 1.3 μm.

17 Claims, 2 Drawing Sheets

FIG. 1
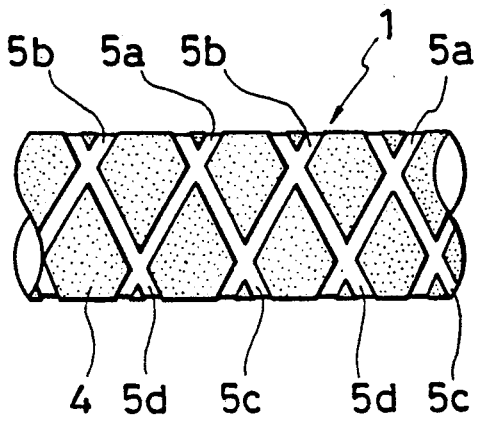
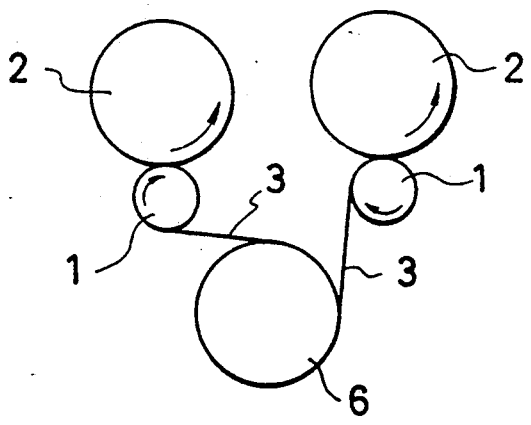
FIG. 2(a)
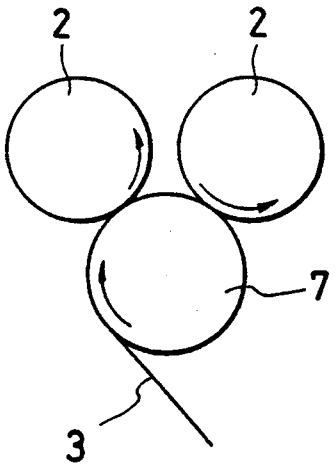
FIG. 2(b)

TOUCH ROLLER FOR PLASTIC POLYMER FILM MANUFACTURING APPARATUS

TECHNICAL FIELD

The present invention relates generally to a metallic touch roller used in winding rolls of polymer films, and more particularly, to a touch roller which guides and feeds tapes made of a polymer film such as a polypropylene film onto a take-up roller.

BACKGROUND ART

In the conventional method and apparatus for manufacturing tapes or rolls of plastic film using, for example, a polymer film such as polypropylene, the polypropylene film is continuously extruded using a conventional process such as a tubular film or a T-die process. The resultant extruded or molded film is cut to a predetermined width by passing the film through a slitter to cut off excess material from each side edge of the film. In a later step, the film is cut into tapes having predetermined widths by slitting the film with the resultant tapes continuously collected onto take-up rollers. To avoid damage to the film, the take-up rollers are designed to avoid lengthwise creasing of the film and to minimize film weaving on a take-up core. This in turn avoids lateral displacement of successive tape layers causing irregular or uneven side edges of the rolled tape.

There are two general types of winders for collecting film tapes which include slitting equipment, known as center winders and surface winders. These winders are adapted to prevent weaving of the film tapes onto the take-up rollers by controlling the collection process such that air is not trapped between the product roll, i.e. collecting core, and the extruded film FIGS. 2(*a*) and 2(*b*) are schematic diagrams of typical center and surface winders, respectively.

In the center winder configuration of FIG. 2(*a*), polypropylene film 3 provides by main supply roller 6 is slit in half, each half constituting a polypropylene tape which is guided to a respective touch roller 1. Each touch roller 1 is in contact with a respective take-up roller 2 onto which polypropylene tapes 3 are wound. In the surface winder configuration of FIG. 2(*b*), polypropylene film 3 is slit in half as it passes to a single touch roller 7. Each tape 3 is guided onto respective take-up rollers 2 angularly displaced about touch roller 4. In both configurations, the touch roller(s) guide the polypropylene film 3 and minimize wrinking and creasing of the polypropylene film 3 as the film is wound onto the respective take-up rollers 2.

In either configuration, the touch rollers may have a soft flexible covering made of rubber or polyurethane material. However, rubber and polyurethane covered rollers are prone to pick up minute foreign materials, such as dust, which is attracted to the roller by static electricity accumulated on the roller. The foreign material can be adsorbed and embedded into the relatively soft rubber or polyurethane surface of the roller. This produces an irregular roller surface which deforms the film passing over the roller with each rotation. The resultant surface flaws made in the collected film tape degrades the electrical insulation characteristics of the film. Thus, rubber or polyurethane covered touch rollers are unsuitable for producing films used for electrical insulation such as dielectric material of capacitors.

Metallic rollers having a grooved surface are known alternatives to flexible rubber or polyurethane covered touch rollers. However, a grooved metallic roller of this type is apt to have sharp protrusions in its surface. These sharp protrusions may cause defects in the film including small pinhole punctures of the film produced as the film passes over the touch roller. To avoid such damage to the film, it was considered necessary that the contacting surfaces of such metallic touch rollers are made very smooth. For example, the surface of a metallic touch roller may be plated with a metal, such as chromium, which is polished to achieve a specular gloss finish. However, when a roller has such a smooth surface, the plastic polymer film tends to slip across and over the roller surface resulting in weaving of the collected film with resultant decreased production efficiency.

DISCLOSURE OF THE INVENTION

An object of the present invention is to provide a touch roller for a plastic polymer film roll manufacturing apparatus having a slitter winder, wherein the touch roller facilitates collection of the film onto a take-up roller without causing weaving of the film onto the take-up roll and without degrading an electrical insulating property of the film caused by film defects, such as pinhole punctures, in the film.

Another object of the invention is to provide a metallic touch roller suitable for manufacturing rolls of plastic polymer film for capacitors wherein the touch roller has a matte-finished outer rolling surface with a spiral groove therein; the spiral groove extends over the length of the roller. A mean surface roughness of the matte-finished outer rolling surface may be in the range of from 0.5 to 2.0 μm and, preferably, from 1.0 to 1.3 μm.

According to the invention, the metallic touch roller for use in an apparatus for manufacturing thin films has a matte-finished outer rolling surface formed with at least one spiral groove extending over the length of the roller, so that in the operation of continuously winding a thin film tape onto a take-up roller, the film scarcely slips over the matte-finished surface of the touch roller due to increased friction coefficient on the part of the roller surface, and due to the absence of air trapped between the roller surface and the film; hence no weaving or other defects in the resulting film roll which ill-affect the electrical insulation preformance of the capacitor.

Also, since the touch roller of the invention is metallic, any foreign material that is adsorbed on the surface of the roller cannot embed itself in the surface, and therefore no repetitive pinhole punctures are made in the film.

These objects and other objects, features, aspects and advantages of the present invention will become apparent from the following detailed description of the present invention when taken in conjunction with the accompanying drawings.

BRIEF DESCRIPTION OF DRAWINGS

FIG. 1 is a view of the surface of a touch roller for handling plastic films according to the invention.

FIG. 2(*a*) is a diagram of a center type winder for plastic films.

FIG. 2(*b*) is a diagram of a surface type winder for plastic films.

BEST MODE FOR CARRYING OUT THE INVENTION

Figure 3:
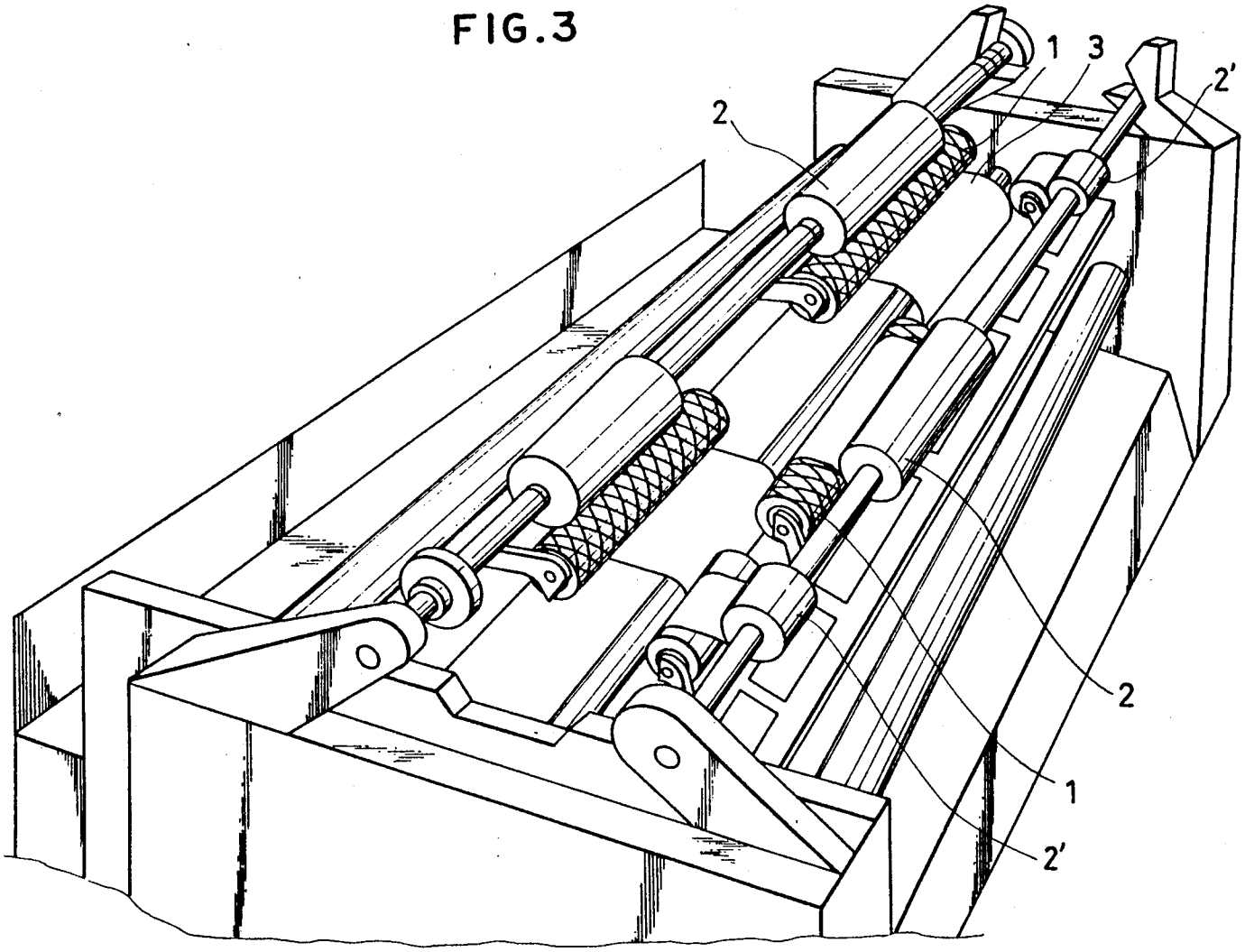
FIG. 3 is a perspective view of a center type winder equipped with touch rollers having similar surfaces as that shown in FIG. 1.

FIG. 1 is a view of the surface of a touch roller 1 for handling plastic films according to the invention. The roller is made of aluminum and its curved surface is plated with chromium. Aluminum is preferred to other heavier metals for the reason of its tendency of creating smaller moment of inertia. The chromium plating can be replaced by nickel plating.

As shown in FIG. 1, the entire curved surface 4 of metallic touch roller 1 has a matte finish, with four spiral grooves 5*a*, 5*b*, 5*c*, 5*d* formed over the entire length of the roller. Grooves 5*a* and 5*b* symmetric to grooves 5*c* and 5*d*. Grooves 5*a* and 5*b* are parallel to each other as are grooves 5*c* and 5*d* such that congruent rhombuses are defined by the grooves. Although four grooves are shown, at least one such groove is required over the surface of the roller so that the air trapped between the surface of the roller and the film being wound can escape through the groove. Providing a path for air to escape decreases film weaving. The spiral groove can be either continuous or discontinuous to prevent creasing of the film. In this best mode it is seen that the grooves are uniformly distributed over the surface of the roller.

The mean surface roughness of the matte-finished surface is in the range from 0.5 to 2.0 μm and preferably from 1.0 to 1.3 μm. In a preferred embodiment of the roller, the mean surface roughness of matte-finished surface is 1.1 μm. If the surface roughness is less than 0.5 μm, the film is not held in place and slips easily across the surface of the roller. A surface roughness of greater than 2.0 μm can result in damage to the film. The surface of the roller can be treated using conventional techniques including sand blasting and etching to achieve the desired surface roughness within the stated ranges.

FIG. 3 is a perspective view of a center type winder equipped with touch rollers 1 having similar surfaces as that shown in FIG. 1. Reference numerals 1, 2, and 3 designate touch rollers, rolls of polypropylene film taken up onto take-up rollers, and polypropylene film, respectively. To facilitate uniformity in the resulting film rolls, the spiral grooves extend uniformly over the touch rollers 1. Excess polypropylene film is cut off by a slitter from each side edge of the extruded film so as to attain a predetermined width, and is rolled up to form film rolls 2'. Simultaneously, the polypropylene film is slit into three tapes and taken up onto the take-up rollers.

Although the present invention has been described and illustrated in detail, it is understood that the same is by way of illustration and example only and is not to be taken by way of limitation, the spirit and scope of the present invention being limited only be the terms of the appended claims.

We claim:

1. A metallic touch roller for use in an apparatus for manufacturing thin films, said touch roller being made entirely from metal and having a matte-finished outer rolling surface formed with at least one spiral groove extending over the length of said roller.

2. A metallic touch roller in accordance with claim 1 wherein the mean surface roughness of said matte-finished outer rolling surface is in the range of from 0.5 to 2.0 μm.

3. A metallic touch roller in accordance with claim 1 wherein the mean surface roughness of said matte-finished outer rolling surface is in the range of from 1.0 to 1.3 μm.

4. A metallic touch roller in accordance with claim 1 wherein the mean surface roughness of said matte-finished outer rolling surface is approximately 1.1 μm.

5. A metallic touch roller is accordance with claim 1 wherein said at least one spiral groove extends uniformly over the length of said roller.

6. A metallic touch roller in accordance with claim 5 wherein a plurality of symmetrically formed spiral grooves extend over the length of said roller.

7. A metallic touch roller in accordance with claim 6 wherein the mean surface roughness of said matte-finished outer rolling surface is in the range of from 0.5 to 2.0 μm.

8. A metallic touch roller in accordance with claim 6 wherein the mean surface roughness of said matte-finished outer rolling surface is in the range of from 1.0 to 1.3 μm.

9. A metallic touch roller in accordance with claim 6 wherein the mean surface roughness of said matte-finished outer rolling surface is approximately 1.1 μm.

10. A metallic touch roller in accordance with claim 6, wherein said plurality of spiral grooves comprise four spiral grooves.

11. A metallic touch roller in accordance with claim 5, wherein said at least one spiral groove comprises four spiral grooves.

12. A metallic touch roller in accordance with claim 6, wherein said plurality of spiral grooves define congruent rhombuses on the surface of the roller.

13. A metallic touch roller in accordance with claim 12, wherein said plurality of spiral grooves comprise four spiral grooves.

14. A metallic touch roller in accordance with claim 1, comprising an aluminum core plated with chromium or nickel to form said outer rolling surface.

15. A metallic touch roller in accordance with claim 4, wherein the aluminum core is plated with nickel.

16. A metallic touch roller in accordance with claim 1, wherein said at least one spiral groove comprises four spiral grooves.

17. In an apparatus for collecting a continuous thin plastic film onto a take-up roll, a metallic touch roller for guiding said film onto said take-up roll, said touch roller being made entirely from metal and having an outer rolling surface which is matte-finished with a mean surface roughness in the range of from 0.5 to 2.0 μm and having a plurality of symmetrically formed spiral grooves extending over the length of said roller.

* * * * *